US005448209A

United States Patent [19]

Hirai et al.

[11] Patent Number: 5,448,209

[45] Date of Patent: Sep. 5, 1995

[54] LAMINATED DIELECTRIC FILTER

[75] Inventors: Takami Hirai, Aichi; Tatsumi Sugiura; Shinsuke Yano, both of Nagoya, all of Japan

[73] Assignee: NGK Insulators, Ltd., Japan

[21] Appl. No.: 219,533

[22] Filed: Mar. 29, 1994

[30] Foreign Application Priority Data

Mar. 31, 1993 [JP] Japan ..... 5-073640

[51] Int. Cl.[6] ..... H01P 1/203

[52] U.S. Cl. ..... 333/204; 333/246

[58] Field of Search ..... 333/203–205, 333/219, 246

[56] References Cited

U.S. PATENT DOCUMENTS

| | | | |
|---|---|---|---|
| 4,418,324 | 11/1983 | Higgins | 333/204 |
| 4,692,726 | 9/1987 | Green et al. | 333/206 |
| 4,963,843 | 10/1990 | Peckham | 333/203 |
| 5,332,984 | 7/1994 | Abe et al. | 333/219 |

FOREIGN PATENT DOCUMENTS

| | | | |
|---|---|---|---|
| 0506476 | 9/1992 | European Pat. Off. | 333/204 |
| 61-258503 | 11/1986 | Japan . | |
| 63-224502 | 9/1988 | Japan . | |
| 64-78001 | 3/1989 | Japan . | |
| 2-62101 | 3/1990 | Japan . | |
| 0251905 | 9/1993 | Japan | 333/204 |
| 0077704 | 3/1994 | Japan | 333/204 |

*Primary Examiner*—Seungsook Ham

*Attorney, Agent, or Firm*—Parkhurst, Wendel & Rossi

[57] ABSTRACT

A laminated dielectric filter has a plurality of resonant elements disposed on a dielectric layer which constitute quarter-wave stripline resonators, respectively. The resonant elements have ends connected to a ground electrode. The dielectric layer also supports a plurality of electrodes having ends connected to the ground electrode and opposite ends spaced from and confronting respective open ends of the resonant elements. The laminated dielectric filter has another dielectric layer which supports thereon an electrode positioned in overlapping relationship to the resonant elements. Still another dielectric layer supports an input electrode positioned in overlapping relationship to the resonant elements and the electrode on the other dielectric layer and an output electrode positioned in overlapping relationship to the resonant elements and the electrode on the other dielectric layer. The laminated dielectric filter provides an attenuation pole to improve attenuation characteristics, suffers less variation of frequency at the pole, and can easily be reduced in size.

9 Claims, 19 Drawing Sheets

LAMINATED DIELECTRIC FILTER

BACKGROUND OF THE INVENTION

1. Field of the Invention

The present invention relates to a laminated dielectric filter, and more particularly to a laminated dielectric filter for use as a high-frequency filter in a high-frequency radio apparatus such as a portable telephone and antenna duplexer.

2. Description of the Prior Art

FIGS. 1 and 2 show, in perspective, a conventional laminated dielectric filter devised by the inventors of the present application.

As shown in FIG. 1, the laminated dielectric filter has a dielectric layer 10 which supports thereon a plurality of resonant elements 14, 16, 18 spaced apart by predetermined intervals from each other, which constitute quarter-wavelength stripline resonators respectively, the resonant elements 14, 16, 18 having ends connected to a ground electrode 12, and a plurality of electrodes 20, 22, 24 having ends connected to the ground electrode 12 and opposite ends spaced apart by predetermined distances from the open ends of the resonant elements 14, 16, 18, respectively, in confronting relationship thereto, resulting in inductive coupling between the resonant elements 14, 16, 18. The laminated dielectric filter also includes another dielectric layer 26 placed on the dielectric layer 10 and supporting thereon an input electrode 28 which is positioned in overlapping relationship to the resonant element 14 on an input terminal side across the dielectric layer 26 and an output electrode 30 which is positioned in overlapping relationship to the resonant element 18 on an output terminal side across the dielectric layer 26. The laminated dielectric filter further includes still another dielectric layer 32 placed on the dielectric layer 26. The dielectric layers 10, 26, 32 are integrally combined into a laminated assembly 40, as shown in FIG. 2.

In FIG. 2, the ground electrode 12 is disposed on upper and lower surfaces of the laminated assembly 40 and side surfaces thereof except input and output terminal areas 42, 44. The input terminal area 42, which is positioned on one side surface of the laminated assembly 40, has an input terminal 46 that is insulated from the ground electrode 12 and connected to the input electrode 28. The output terminal area 44, which is positioned on an opposite side surface of the laminated assembly 40, has an output terminal 48 that is insulated from the ground electrode 12 and connected to the output electrode 30.

FIG. 3 of the accompanying drawings shows an equivalent circuit of the laminated dielectric filter shown in FIGS. 1 and 2. In FIG. 3, the equivalent circuit includes a capacitance 50 between the resonant element 14 and the input electrode 28, a capacitance 52 between the resonant element 18 and the output electrode 30, a capacitance 54 between the resonant element 14 and the electrode 20, a capacitance 56 between the resonant element 16 and the electrode 22, a capacitance 58 between the resonant element 18 and the electrode 24, an inductance 60 indicative of inductive coupling between the resonant elements 14, 16, and an inductance 62 indicative of inductive coupling between the resonant elements 16, 18. The equivalent circuit of such an arrangement serves as a bandpass filter. The equivalent circuit also includes parallel resonant circuits having respective capacitances 64, 66, 68 and respective inductances 70, 72, 74 which are equivalently converted from the respective resonant elements 14, 16, 18.

The bandpass filter has a desired frequency characteristic such as a bandwidth that is obtained by distributed coupling between the resonant elements 14, 16, 18. However, since such coupling is available only between two adjacent the resonant elements of resonant elements 14, 16, 18, it is impossible to provide an attenuation pole for improving attenuation characteristics. While the attenuation characteristics would be improved by increasing the number of resonant elements used, the increased number of resonant elements would also increase the insertion loss of the bandpass filter.

It has been attempted to provide coupling between nonadjacent resonant elements, other than adjacent resonant elements, in order to form an attenuation pole in the attenuation characteristics. For example, it has been proposed to couple nonadjacent resonant elements to form an attenuation pole in the frequency range above or below the passband of the filter, as disclosed in Japanese laid-open patent publication No. 64-78001.

The proposed filter arrangement is, however, disadvantageous in that it requires coupling coils between resonant elements and capacitive elements to couple nonadjacent resonant elements, in addition to the resonant elements themselves, and hence increased manufacturing costs. Furthermore, manufactured filters of such design suffer from variation of frequency at which an attenuation pole appears. In addition, the filter cannot be reduced in size as it includes a large number of parts.

SUMMARY OF THE INVENTION

It is therefore an object of the present invention to provide a laminated dielectric filter which has an attenuation pole for improved attenuation characteristics, suffers less variation of frequency of the attenuation pole, and can easily be reduced in size.

According to the present invention, there is provided a laminated dielectric filter comprising a dielectric body, a first resonant element disposed in the dielectric body and having a first main surface and a second main surface opposite to the first main surface, a second resonant element disposed in the dielectric body and having a first main surface and a second main surface opposite to the first main surface thereof, a first electrode disposed in the dielectric body in confronting relationship to a portion of the first main surface of the first resonant element and a portion of the first main surface of the second resonant element, and a second electrode disposed in the dielectric body in confronting relationship to a portion of the second main surface of the first resonant element and a portion of the first electrode.

The laminated dielectric filter may further comprise a third electrode disposed in the dielectric body in confronting relationship to a portion of the second main surface of the second resonant element and a portion of the first electrode.

The laminated dielectric filter may further comprise a third resonant element disposed in the dielectric body on a side of the second resonant element opposite to the first resonant element, the third resonant element having a first main surface and a second main surface opposite to the first main surface thereof, the third electrode confronting a portion of the second main surface of the third resonant element.

The laminated dielectric filter may further comprise a fourth electrode disposed in the dielectric body in confronting relationship to a portion of the first main surface of the third resonant element and a portion of the third electrode.

The second electrode may be used as either one of input and output electrodes.

Where the laminated dielectric filter includes first and second resonant elements, the second electrode may be used as an input electrode or an output electrode, and the third electrode may be used as the other of the input and output electrodes. Where the laminated dielectric filter includes first, second, and third resonant elements, the second electrode may be used as one of input and output electrodes, and the fourth electrode may be used as the other of input and output electrodes.

With an arrangement of the laminated dielectric filter of the present invention described above, capacitances are formed between the first resonant element and the first electrode, the first resonant element and the second electrode, and the second resonant element and the first electrode, and a capacitance is also formed between the first and second electrodes. The capacitance formed between the first and second electrodes serves as a jumped coupling capacitance which couples the front stage and the back stage of the first resonant element while skipping the first resonant element, and produces an attenuation pole below the passband of the laminated dielectric filter that serves as a bandpass filter.

Where the third electrode is disposed in the dielectric body in a manner as described above, a capacitance is formed between the second and third electrodes, and serves as a jumped coupling capacitance which couples the front stage and the back stage of the second resonant element while skipping the second resonant element. The jumped coupling capacitance is effective in producing an attenuation pole below the passband of the laminated dielectric filter as a bandpass filter.

Where the third resonant element is disposed in the dielectric body in a manner as described above, a capacitance is formed between the third and fourth electrodes, and serves as a jumped coupling capacitance which couples the front stage and the back stage of the third resonant element while skipping the third resonant element. The jumped coupling capacitance is also effective in producing an attenuation pole below the passband of the laminated dielectric filter as a bandpass filter.

The capacitances between the first through third resonant elements and the first through fourth electrodes, and the capacitance of jumped coupling capacitors which couple the front and the back stage of the first through third resonant elements are produced by the dielectric body, the first through third resonant elements, and the first through fourth electrodes. Therefore, no other discrete parts are required to form these capacitances. Consequently, no extra manufacturing steps are required to manufacture the laminated dielectric filter. And a laminated dielectric filter having a reduced size can be easily manufactured as no extra discrete parts are used.

As described above, the capacitances between the first through third resonant elements and the first through fourth electrodes, and the jumped coupling capacitances across the first through third resonant elements are produced by the dielectric body, the first through third resonant elements, and the first through fourth electrodes. Inasmuch as it is relatively easy to control the distances between the resonant elements and the electrodes, the areas in which they overlap each other, the distances between the electrodes, and the areas in which they overlap each other, it is also relatively easy to control the values of the capacitances formed between these resonant elements and electrodes. Consequently, variation of frequency of the attenuation pole can easily be prevented from occurring.

The above and other objects, features, and advantages of the present invention will become apparent from the following description when taken in conjunction with the accompanying drawings which illustrate preferred embodiments of the present invention by way of example.

DETAILED DESCRIPTION OF THE PREFERRED EMBODIMENTS

1st Embodiment

Figure 1:
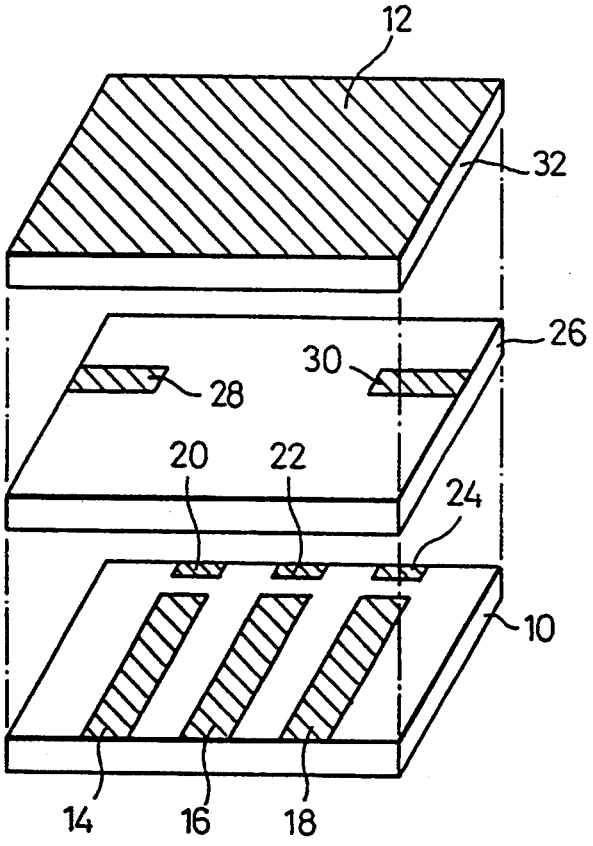
FIG. 1 (prior art)
FIG. 1 is an exploded perspective view of a conventional laminated dielectric filter.
Figure 2:
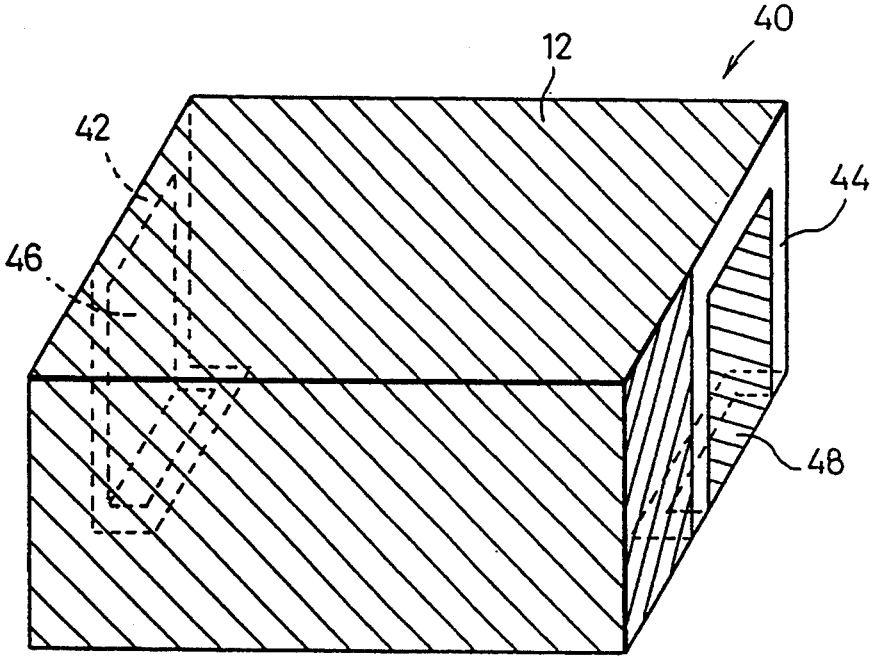
FIG.2 (prior art)
FIG. 2 is a perspective view of the conventional laminated dielectric filter.
Figure 3:
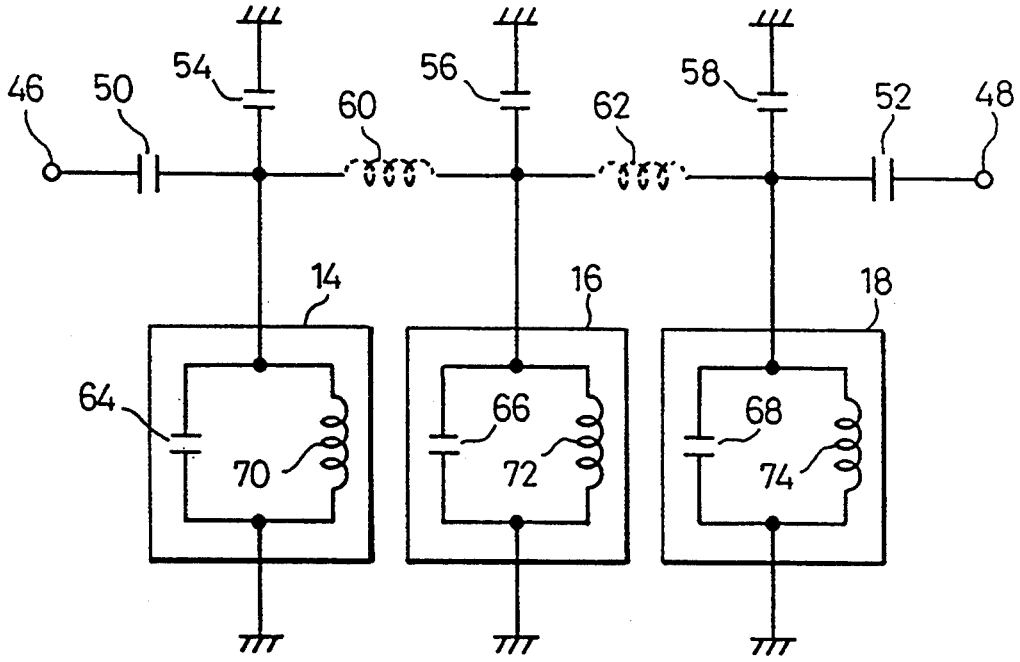
FIG. 3 (prior art)
FIG. 3 is a circuit diagram of an equivalent circuit of the conventional laminated dielectric filter.
Figure 4:
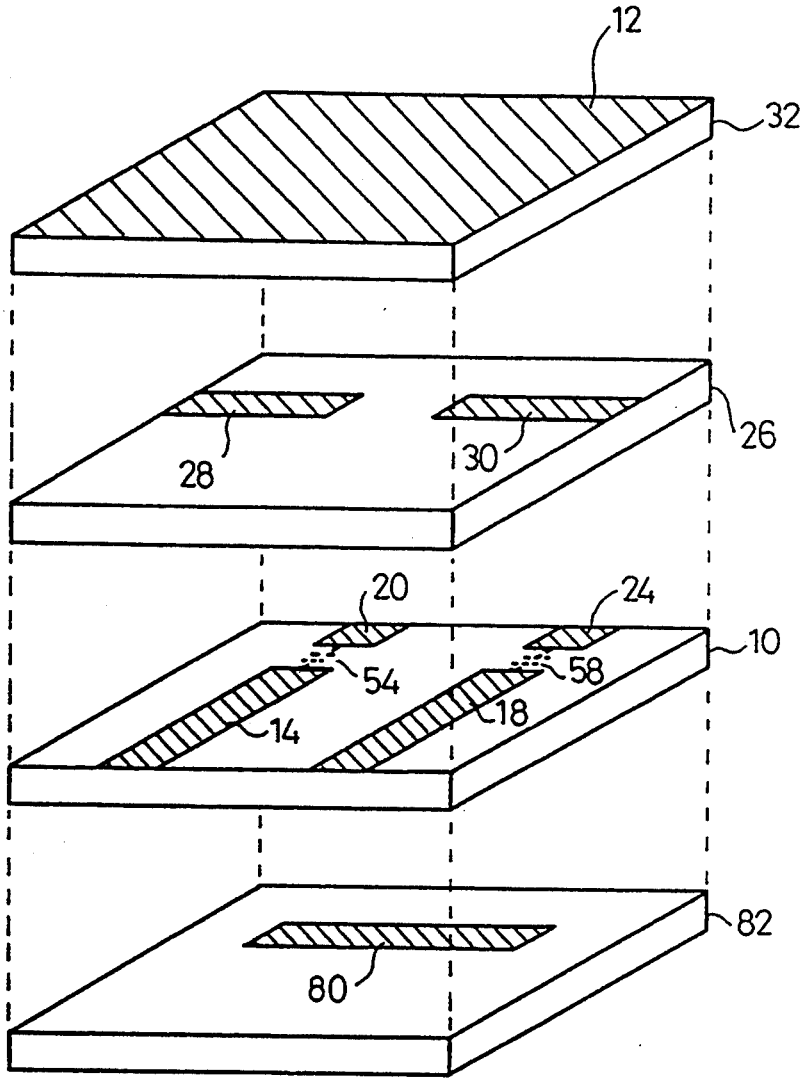
FIG. 4 is an exploded perspective view of a laminated dielectric filter according to a first embodiment of the present invention.

As shown in FIG. 4, a laminated dielectric filter according to a first embodiment of the present invention comprises a plurality of dielectric layers 82, 10, 26, 32. The dielectric layer 10, which is placed on the dielectric layer 82, supports thereon a pair of resonant elements 14, 18 spaced apart at a predetermined interval from each other and each constitutes a quarter-wavelength stripline resonator, the resonant elements 14, 18 having ends connected to a ground electrode 12 disposed on the face side of the dielectric layer 32, and a pair of electrodes 20, 24 having ends connected to the ground electrode 12 and opposite ends spaced apart at predetermined distances from the open ends of the resonant elements 14, 18, respectively, in confronting relationship thereto. Distributed coupling between the resonant elements 14, 18 provides a comb-line filter. The resonant element 14 is positioned on an input side, and the resonant element 18 is positioned on an output side.

The dielectric layer 82 supports thereon an electrode 80 positioned in overlapping relationship to the resonant elements 14, 18 across the dielectric layer 10. The ground electrode 12 is also disposed on the reverse side of the dielectric layer 82.

The dielectric layer 26 is placed on the dielectric layer 10 and supports thereon an input electrode 28 which is positioned in overlapping relationship to the resonant element 14 across the dielectric layer 26, extends substantially perpendicularly to the resonant element 14, is positioned in overlapping relationship to the electrode 80 across the dielectric layers 10, 26, and an output electrode 30 which is positioned in overlapping relationship to the resonant element 18 across the dielectric layer 26, extends substantially perpendicularly to the resonant element 18, and is positioned in overlapping relationship to the electrode 80 across the dielectric layers 10, 26. The dielectric layer 32 with the ground electrode 12 is placed on the dielectric layer 26. The dielectric layers 82, 10, 26, 32 are integrally combined into a laminated assembly 40.

Figure 5:
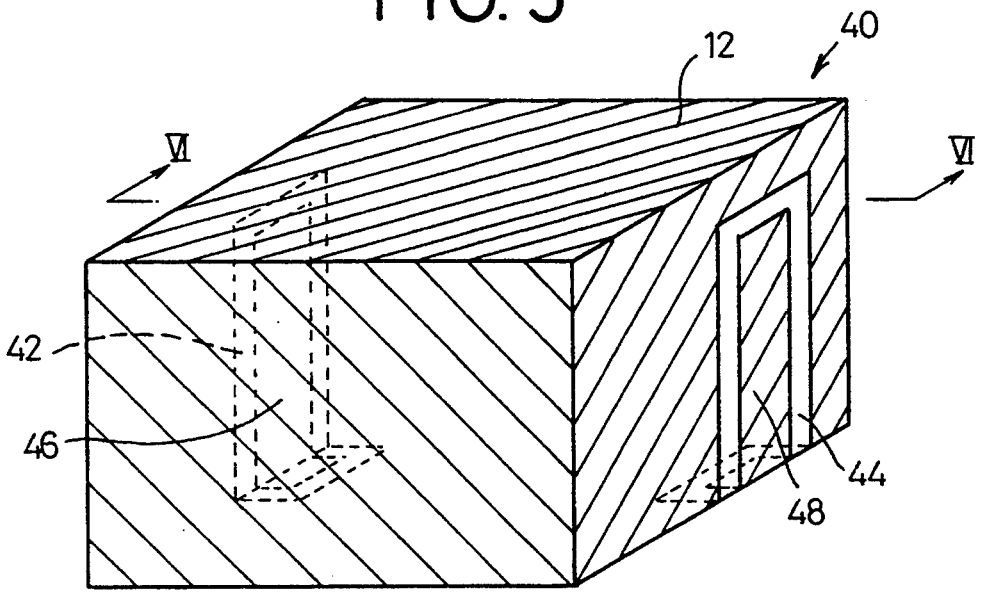
FIG. 5 is a perspective view of the laminated dielectric filter according to the first embodiment.

As shown in FIG. 5, the ground electrode 12 is disposed on upper and lower surfaces of the laminated assembly 40 and side surfaces thereof except input and output terminal areas 42, 44. The input terminal area 42, which is positioned on one side surface of the laminated assembly 40, has an input terminal 46 that is insulated from the ground electrode 12 and connected to the input electrode 28. The output terminal area 44, which is positioned on an opposite side surface of the laminated assembly 40, has an output terminal 48 that is insulated from the ground electrode 12 and connected to the output electrode 30.

Figure 6:
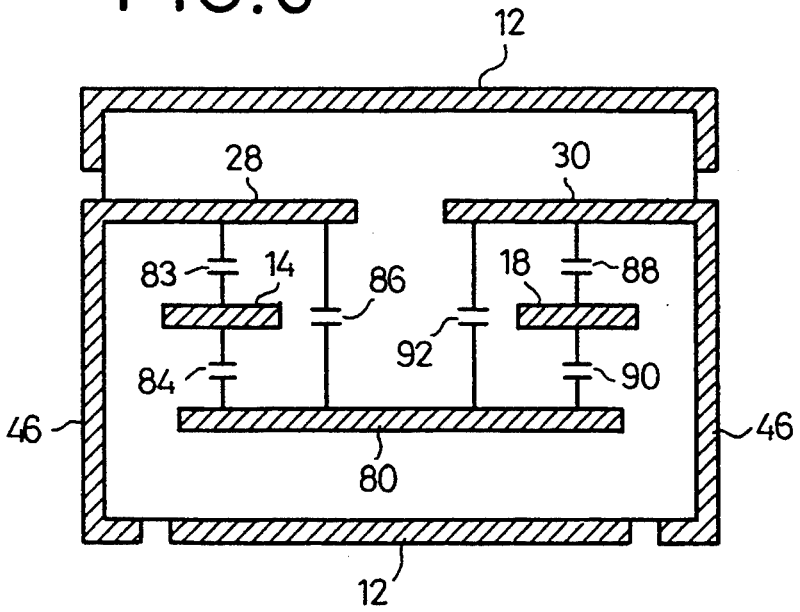
FIG. 6 is a cross-sectional view taken along line VI—VI of FIG. 5.

As shown in FIGS. 4 and 6, the resonant element 14 and the input electrode 28 overlap each other across the dielectric layer 26, and are electrostatically coupled to each other across the dielectric layer 26 through a capacitance 83. The resonant element 14 and the electrode 80 overlap each other across the dielectric layer 10, and are electrostatically coupled to each other across the dielectric layer 10 through a capacitance 84.

The input electrode 28 and the electrode 80 overlap each other across the dielectric layers 10, 26, and are electrostatically coupled to each other across the dielectric layers 10, 26 through a capacitance 86.

The resonant element 18 and the output electrode 30 overlap each other across the dielectric layer 26, and are electrostatically coupled to each other across the dielectric layer 26 through a capacitance 88. The resonant element 18 and the electrode 80 overlap each other across the dielectric layer 10, and are electrostatically coupled to each other across the dielectric layer 10 through a capacitance 90.

The output electrode 30 and the electrode 80 overlap each other across the dielectric layers 10, 26, and are electrostatically coupled to each other across the dielectric layers 10, 26 through a capacitance 92.

As shown in FIG. 4, the resonant elements 14, 18 have respective open ends that are electrostatically coupled to the electrodes 20, 24, respectively, through respective capacitances 54, 58. Because of the capacitances 54, 58, the length of the resonant elements 14, 18 is reduced to a quarter wavelength or less.

Figure 7:
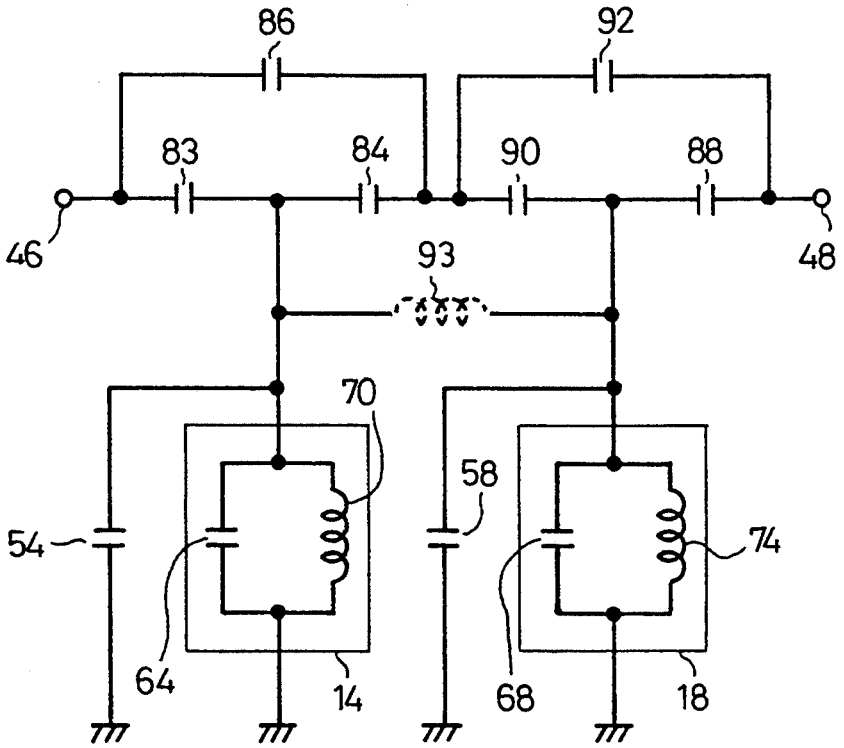
FIG. 7 is a circuit diagram of an equivalent circuit of the laminated dielectric filter according to the first embodiment.

The laminated dielectric filter thus constructed according to the first embodiment has an equivalent circuit as shown in FIG. 7 which exhibits bandpass filter characteristics. The equivalent circuit includes parallel resonant circuits having respective capacitances 64, 68 and respective inductances 70, 74 which are equivalently converted from the respective resonant elements 14, 18.

In the first embodiment, the capacitance 83 is present on the input side of the resonant element 14, and the capacitance 84 is present on the output side of the resonant element 14, with the capacitance 86 being present as a jumped coupling capacitance so as to couple the capacitances 83, 84 on the respective opposite sides of the resonant element 14. Similarly, the capacitance 90 is present on the input side of the resonant element 18, and the capacitance 88 is present on the output side of the resonant element 18, with the capacitance 92 being present as a jumped coupling capacitance so as to couple the capacitances 90, 88 on the respective opposite sides of the resonant element 18. These jumped coupling capacitances 86, 92 are effective to produce an attenuation pole below the passband of the bandpass filter. In FIG. 7, the resonant elements 14, 18 are coupled to each other by inductive coupling through an inductance 93.

The frequency at which the attenuation pole is produced varies depending on the capacitances 83, 84, 86, 90, 88, 92.

The value of capacitance 83 is determined by the thickness of the dielectric layer 26 and the area in which the resonant element 14 and the input electrode 28 confront each other, and the value of capacitance 84 is determined by the thickness of the dielectric layer 10 and the area in which the resonant element 14 and the electrode 80 confront each other. The value of capacitance 86 is determined by the thicknesses of the dielectric layers 10, 26 and the area in which the input electrode 28 and the electrode 80 confront each other. The value of capacitance 88 is determined by the thickness of the dielectric layer 26 and the area in which the resonant element 18 and the output electrode 30 confront each other, and the value of capacitance 90 is determined by the thickness of the dielectric layer 10 and the area in which the resonant element 18 and the electrode 80 confront each other. The value of capacitance 92 is determined by the thicknesses of the dielectric layers 10, 26 and the area in which the output electrode 30 and the electrode 80 confront each other. Since it is relatively easy to control, without variations, the thicknesses of the dielectric layers 10, 26, the areas in which the resonant elements 14, 18 confront the input and output electrodes 28, 30 and the electrode 80, and the areas in which the input and output electrodes 28, 30 confront the electrode 80, it is also relatively easy, without variations, to control the values of the capacitances 83, 84, 86, 90, 88, 92. Consequently, any variations of the frequency of the attenuation pole can easily be reduced.

The capacitance 83 is produced by the electrostatic coupling between the resonant element 14 and the input electrode 28, the capacitance 84 by the electrostatic coupling between the resonant element 14 and the electrode 80, the capacitance 86 by the electrostatic coupling between the input electrode 28 and the electrode 80, the capacitance 88 by the electrostatic coupling between the resonant element 18 and the output electrode 30, the capacitance 90 by the electrostatic coupling between the resonant element 18 and the electrode 80, and the capacitance 92 by the electrostatic coupling between the output electrode 30 and the electrode 80. Therefore, no other parts are required to form these capacitances. Consequently, no extra manufacturing steps are required to manufacture a laminated dielectric filter. And the laminated dielectric filter having a reduced size can be easily manufactured as no extra discrete parts are used.

A process of manufacturing the laminated dielectric filter according to the first embodiment will be described below.

Inasmuch as the resonant elements 14, 18, the electrodes 20, 24, the input electrode 28, the output electrode 30, and the electrode 80 are fully embedded in a dielectric body of the dielectric assembly 40, it is preferable that the resonant elements 14, 18, the electrodes 20, 24, the input electrode 28, the output electrode 30, and the electrode 80 are in all made of a material having a low specific resistance, preferably, a conductive material composed of Ag or Cu having a low specific resistance.

The dielectric body should preferably be made of a ceramic dielectric material because the ceramic dielectric material has high reliability and has a large dielectric constant $\epsilon_r$, which enables the reduction in size of the dielectric laminated filter.

For manufacturing the laminated dielectric filter, it is preferable to coat conductive paste on respective green sheets containing ceramic powder to form an electrode pattern thereon, then stacking the green sheets to form the assembly in which the pattern is formed by the conductive paste, firing the assembly to make it dense, so that the electrodes are formed integrally in the ceramic dielectric material.

When a conductive material composed of Ag or Cu is used, it is difficult to co-fire the conductors with normally-used dielectric material, because the conductors have a low melting point. Therefore, it is necessary to employ a dielectric material which can be fired at a temperature lower than the melting points (1100° C. or lower) of these conductive materials. Because of the nature of the laminated dielectric filter for use as a microwave filter, it is desirable to employ such a dielectric material that the temperature characteristic (temperature coefficient) of the resonant frequency of the parallel resonant circuits is ±50 ppm/° C. or below. Such a dielectric material may be a glass material such as a mixture of cordierire glass powder, $TiO_2$ powder, and $Nd_2Ti_2O_7$ powder, a $BaO—TiO_2—Re_2O_3—Bi_2O_3$ composition (Re: rare earth component) with a slight amount of glass forming component or glass powder added thereto, or dielectric composition powder of barium oxide—titanium oxide—neodymium oxide with a slight amount of glass powder added thereto.

According to an example, 73 wt % of glass powder having a composition of MgO:18 wt %—$Al_2O_3$:37 wt %—$SiO_2$:37 wt %—$B_2O_3$:5 wt %—$TiO_2$: 3 wt %, 17 wt % of commercially available $TiO_2$ powder, and 10 wt % of $Nd_2Ti_2O_7$ powder were sufficiently mixed together, thus producing a mixed powder. The $Nd_2Ti_2O_7$ powder was prepared by temporarily firing $Nd_2O_7$ powder and $TiO_2$ powder and then crushing the fired mass. Then, to the mixed powder were added an acrylic organic binder, a plasticizer, a toluene-based solvent, and an alcohol-based solvent. They were sufficiently mixed into a slurry by flint pebbles of alumina. Then, a green sheet having a thickness ranging from 0.2 mm to 0.5 mm was produced from the slurry by the doctor blade method.

In the first embodiment, conductive patterns shown in FIG. 4 were printed on respective green sheets using a silver contained paste as a conductive paste, and green sheets are stacked to get the desired total thickness, and the structure shown in FIG. 4 can be obtained. Thereafter, the stack was fired at 900° C., thereby manufacturing the laminated assembly 40.

Then, a silver contained paste was printed on the upper and lower surfaces of the laminated assembly 40 and the side surfaces thereof except the input and output terminal areas 42, 44, to form a ground electrode 12. Electrodes insulated from the ground electrode 12 and connected respectively to the input and output electrodes 28, 30 were formed by printing input and output terminals 46, 48 with the silver contained paste thereon, and then baked at 850° C. In this manner, the laminated dielectric filter according to the first embodiment was manufactured.

2nd Embodiment

Figure 8:
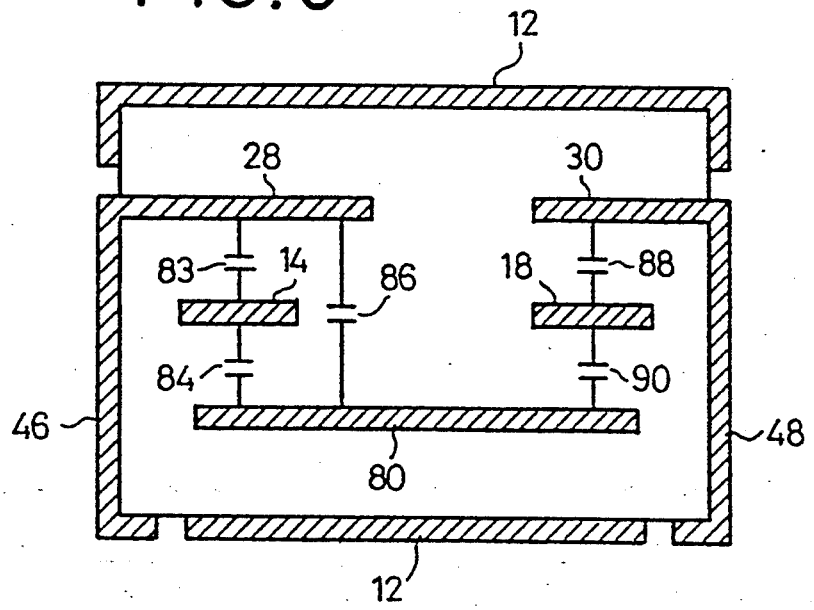
FIG. 8 is a cross-sectional view of a laminated dielectric filter according to a second embodiment of the present invention.
Figure 9:
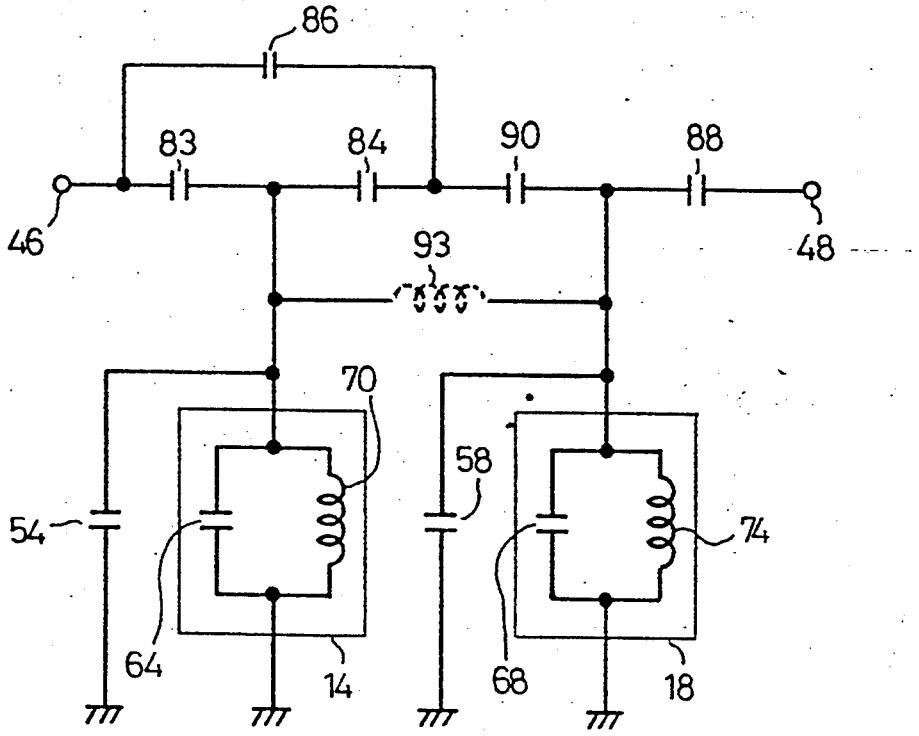
FIG. 9 is a circuit diagram of an equivalent circuit of the laminated dielectric filter according to the second embodiment.

FIGS. 8 and 9 show a laminated dielectric filter according to a second embodiment of the present invention.

The laminated dielectric filter according to the second embodiment differs from the laminated dielectric filter according to the first embodiment in that an output electrode 30 is positioned in confronting relationship to a resonant element 18 only, but not an electrode 80. The other structural details of the laminated dielectric filter according to the second embodiment are the same as those of the laminated dielectric filter according to the first embodiment. The laminated dielectric filter according to the second embodiment may be manufactured in the same manner as the laminated dielectric filter according to the first embodiment.

Since the output electrode 30 is not positioned in confronting relationship to the electrode 80, no jumped coupling capacitance is formed to couple capacitances 90, 88 on the opposite sides of the resonant element 18. However, a jumped coupling capacitance 86 formed to couple capacitances 83, 84 on the opposite sides of a resonant element 14 is effective to produce an attenuation pole below the passband of the bandpass filter.

In the second embodiment, an input electrode 28 is positioned in confronting relationship to the electrode 80 and the output electrode 30 is not positioned in confronting relationship to the electrode 80. However, the input electrode 28 may not be positioned in confronting relationship to the electrode 80 and the output electrode 30 may be positioned in confronting relationship to the electrode 80. In such a modification, while no jumped coupling capacitance is formed to couple the capacitances 83, 84 on the opposite sides of the resonant element 14, a jumped coupling capacitance is formed to couple the capacitances 90, 88 on the opposite sides of the resonant element 18 (see FIG. 7), so that an attenuation pole is produced below the passband of the bandpass filter.

3rd Embodiment

Figure 10:
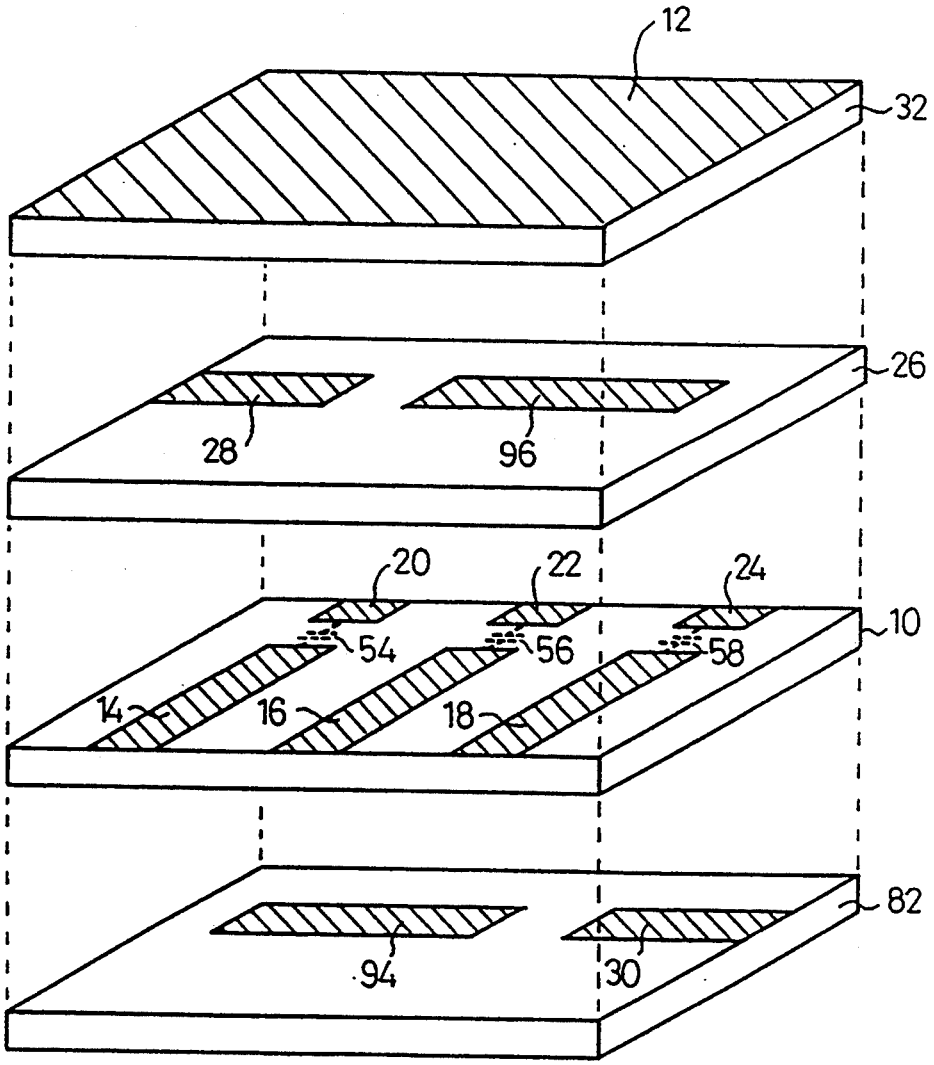
FIG. 10 is an exploded perspective view of a laminated dielectric filter according to a third embodiment of the present invention.
Figure 11:
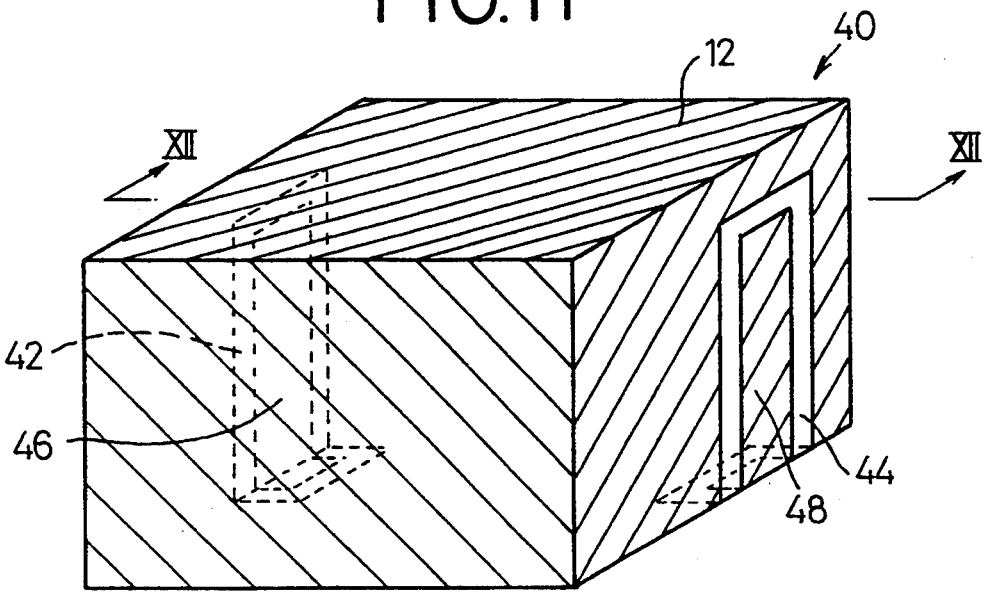
FIG. 11 is a perspective view of the laminated dielectric filter according to the third embodiment.
Figure 12:
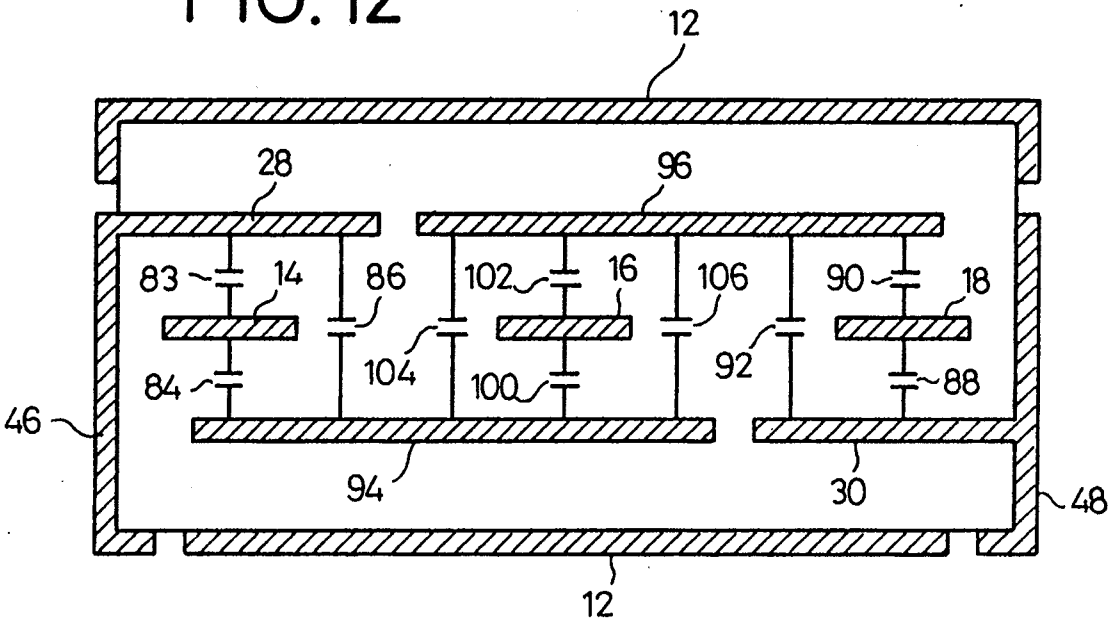
FIG. 12 is a cross-sectional view taken along line XII—XII of FIG. 11.

FIGS. 10 through 12 show a laminated dielectric filter according to a third embodiment of the present invention.

As shown in FIG. 10, the laminated dielectric filter according to the third embodiment comprises a plurality of dielectric layers 82, 10, 26, 32. The dielectric layer 10, which is placed on the dielectric layer 82, supports thereon a plurality of resonant elements 14, 16, 18 spaced apart by predetermined intervals from each other and each composed of a quarter-wavelength stripline resonator, the resonant elements 14, 16, 18 having ends connected to a ground electrode 12 disposed on the face side of the dielectric layer 32, and a plurality of electrodes 20, 22, 24 having ends connected to the ground electrode 12 and opposite ends spaced apart by predetermined distances from the open ends of the resonant elements 14, 16, 18, respectively, in confronting relationship thereto. The length of the resonant elements 14, 16, 18 is reduced to a quarter wavelength or less. The resonant element 14 is positioned on an input side, and the resonant element 18 is positioned on an output side.

The dielectric layer 82 supports thereon an electrode 94 positioned in overlapping relationship to the resonant elements 14, 16 across the dielectric layer 10, and an output electrode 30 positioned in overlapping relationship to the resonant element 18 across the dielectric layer 10, extending substantially perpendicularly to the resonant element 18, and positioned in overlapping relationship to a resonant element 96 (described later on) across the dielectric layers 10, 26. The ground electrode 12 is also disposed on the reverse side of the dielectric layer 82.

The dielectric layer 26 is placed on the dielectric layer 10 and supports thereon an input electrode 28 which is positioned in overlapping relationship to the resonant element 14 across the dielectric layer 26, extends substantially perpendicularly to the resonant element 14, is positioned in overlapping relationship to the electrode 94 across the dielectric layers 10, 26, and an electrode 96 which is positioned in overlapping relationship to the resonant elements 16, 18 across the dielectric layer 26. The dielectric layer 32 with the ground electrode 12 is placed on the dielectric layer 26. The dielectric layers 82, 10, 26, 32 are integrally combined into a laminated assembly 40 (see FIG. 11).

As shown in FIG. 11, the ground electrode 12 is disposed on upper and lower surfaces of the laminated assembly 40 and side surfaces thereof except input and output terminal areas 42, 44. The input terminal area 42, which is positioned on one side surface of the laminated assembly 40, has an input terminal 46 that is insulated from the ground electrode 12 and connected to the input electrode 28. The output terminal area 44, which is positioned on an opposite side surface of the laminated assembly 40, has an output terminal 48 that is insulated from the ground electrode 12 and connected to the output electrode 30.

As shown in FIGS. 10 and 12, the resonant element 14 and the input electrode 28 overlap each other across the dielectric layer 26, and are electrostatically coupled to each other across the dielectric layer 26 through a capacitance 83. The resonant element 14 and the electrode 94 overlap each other across the dielectric layer 10, and are electrostatically coupled to each other across the dielectric layer 10 through a capacitance 84.

The input electrode 28 and the electrode 94 overlap each other across the dielectric layers 10, 26, and are electrostatically coupled to each other across the dielectric layers 10, 26 through a capacitance 86.

The resonant element 16 and the electrode 94 overlap each other across the dielectric layer 10, and are electrostatically coupled to each other across the dielectric layer 10 through a capacitance 100. The resonant element 16 and the electrode 96 overlap each other across the dielectric layer 26, and are electrostatically coupled to each other across the dielectric layer 26 through a capacitance 102.

The electrodes 94, 96, one on each side of the resonant element 16, overlap each other across the dielectric layers 10, 26, and are electrostatically coupled to each other across the dielectric layers 10, 26 through capacitances 104, 106.

The resonant element 18 and the output electrode 30 overlap each other across the dielectric layer 10, and are electrostatically coupled to each other across the dielectric layer 10 through a capacitance 88. The resonant element 18 and the electrode 96 overlap each other across the dielectric layer 26, and are electrostatically coupled to each other across the dielectric layer 26 through a capacitance 90.

The output electrode 30 and the electrode 96 overlap each other across the dielectric layers 10, 26, and are electrostatically coupled to each other across the dielectric layers 10, 26 through a capacitance 92.

As shown in FIG. 10, the resonant elements 14, 16, 18 have respective open ends that are electrostatically coupled to the electrodes 20, 22, 24, respectively, through respective capacitances 54, 56, 58. Because of the capacitances 54, 56, 58, the length of the resonant elements 14, 16, 18 is reduced to a quarter wavelength or less.

Figure 13:
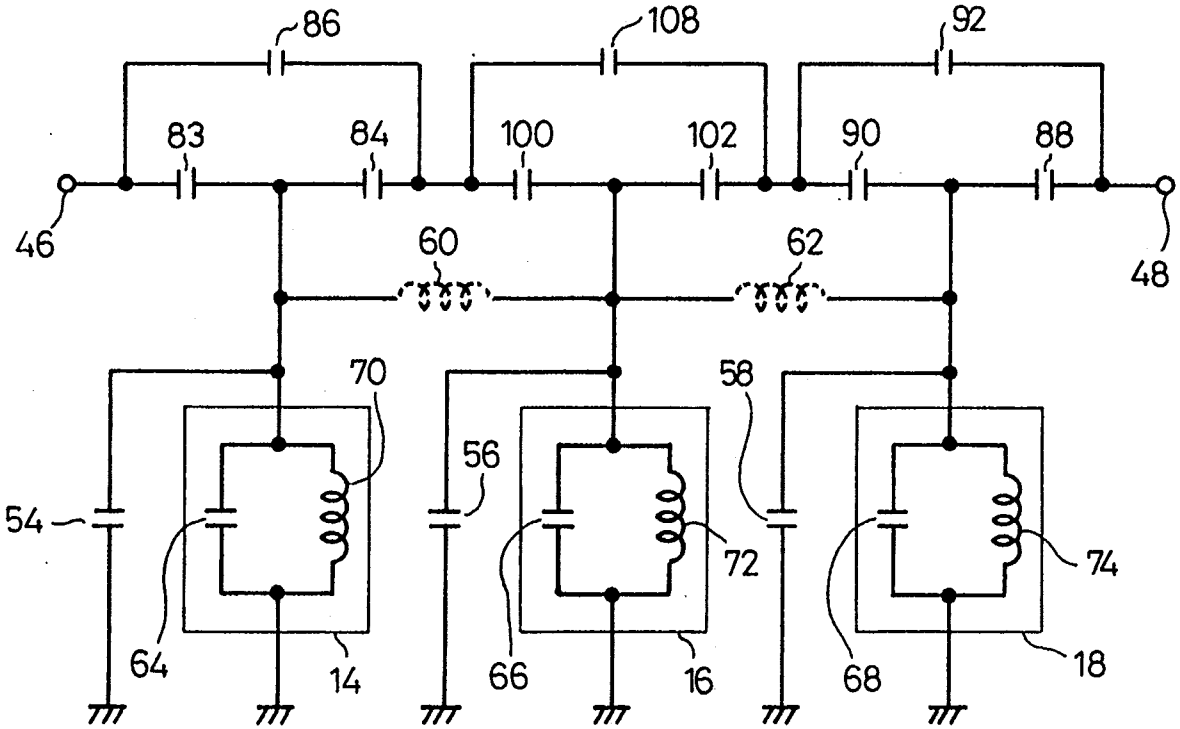
FIG. 13 is a circuit diagram of an equivalent circuit of the laminated dielectric filter according to the third embodiment.

The laminated dielectric filter thus constructed according to the third embodiment has an equivalent circuit as shown in FIG. 13 which exhibits bandpass filter characteristics. The equivalent circuit includes a capacitance 108 which is a combination of the capacitances 104, 106 that are present between the electrodes 94, 96 on opposite sides of the resonant element 16. The equivalent circuit also includes parallel resonant circuits having respective capacitances 64, 66, 68 and respective inductances 70, 72, 74 which are equivalently converted from the respective resonant elements 14, 16, 18.

In the third embodiment, the capacitance 83 is present on the input side of the resonant element 14, and the capacitance 84 is present on the output side of the resonant element 14, with the capacitance 86 being present as a jumped coupling capacitance so as to couple the capacitances 83, 84 on the respective opposite sides of the resonant element 14. Similarly, the capacitance 100 is present on the input side of the resonant element 16, and the capacitance 102 is present on the output side of the resonant element 16, with the combined capacitance 108 being present as a jumped coupling capacitance so as to couple the capacitances 100, 102 on the respective opposite sides of the resonant element 16. The capacitance 90 is present on the input side of the resonant element 18, and the capacitance 88 is present on the output side of the resonant element 18, with the capacitance 92 being present as a jumped coupling capacitance so as to couple the capacitances 90, 88 on the respective opposite sides of the resonant element 18. These jumped coupling capacitances 86, 108, 92 are effective to produce an attenuation pole below the passband of the bandpass filter.

A process of manufacturing the laminated dielectric filter according to the third embodiment will be described below. In an example, conductive patterns shown in FIG. 10 were printed on respective green sheets, identical to those used in the first embodiment, using a silver contained paste as a conductive paste, and green sheets with the printed conductive patterns are stacked to get the desired total thickness, and the structure shown in FIG. 10 can be obtained. Thereafter, the stack was fired at 900° C., thereby manufacturing the laminated assembly 40.

Then, the upper and lower surfaces of the laminated assembly 40 and the side surfaces thereof except the input and output terminal areas 42, 44 are printed with a silver contained paste to form a ground electrode 12. Electrodes insulated from the ground electrode 12 and connected respectively to the input and output electrodes 28, 30 are formed by printing input and output terminals 46, 48 with the silver contained paste thereon, and then baked at 850° C. In this manner, the laminated dielectric filter according to the third embodiment was manufactured.

4th Embodiment

Figure 14:
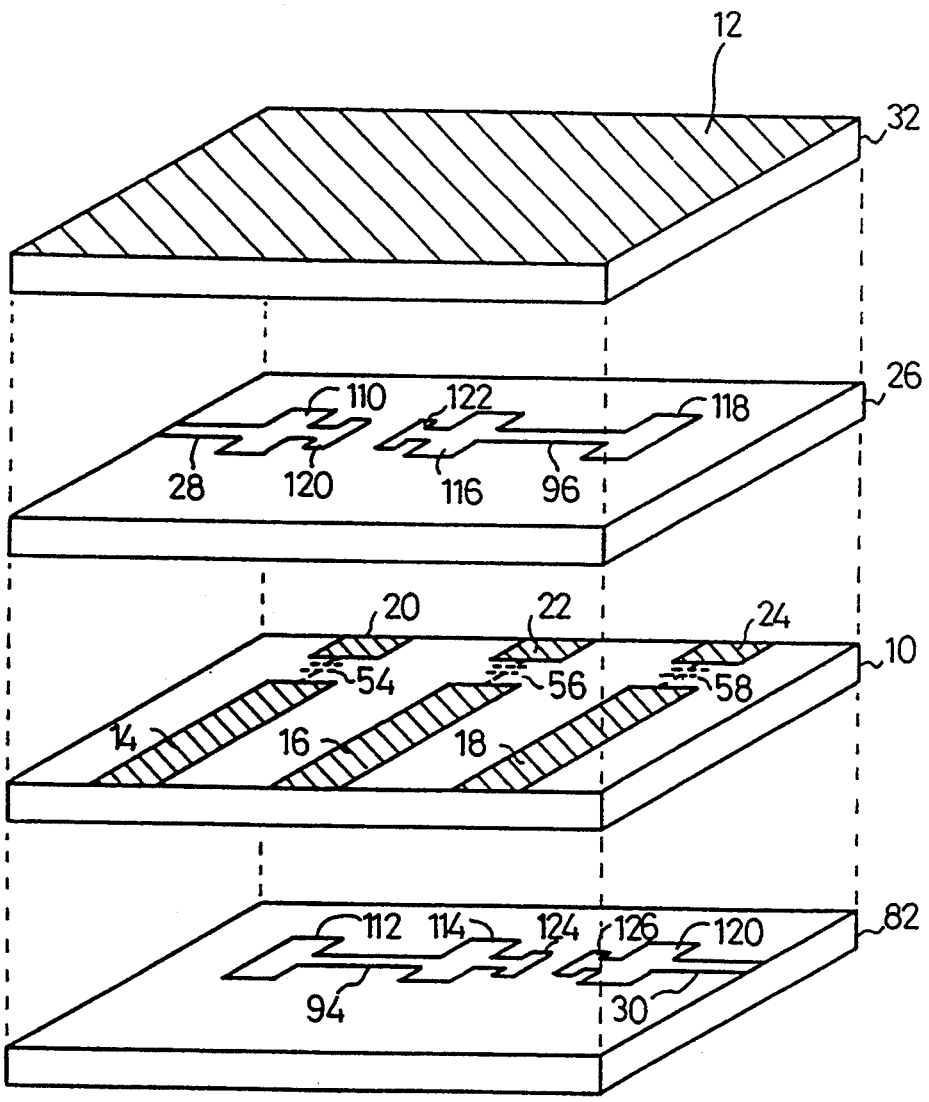
FIG. 14 is an exploded perspective view of a laminated dielectric filter according to a fourth embodiment of the present invention.
Figure 15:
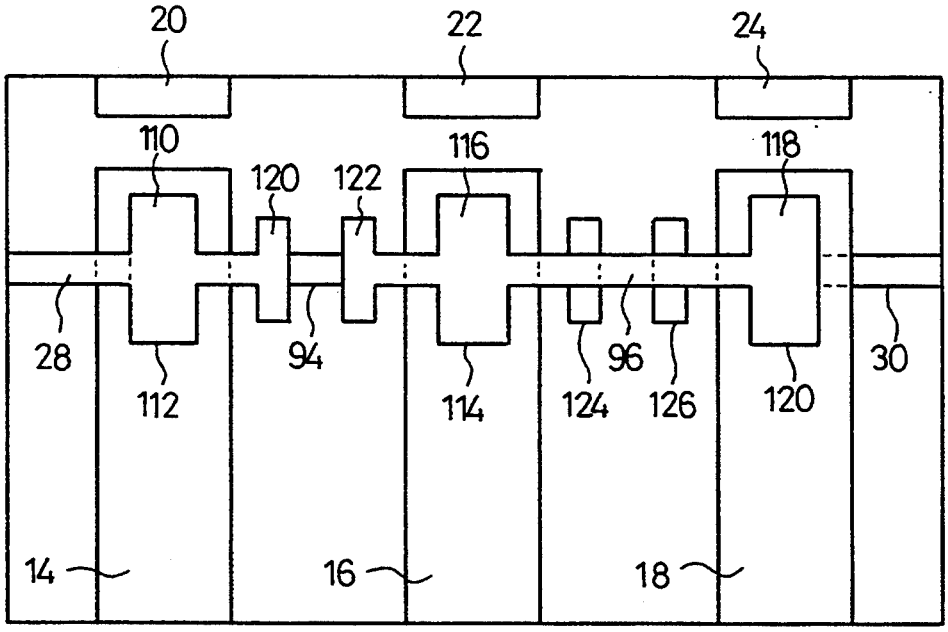
FIG. 15 is a plan view of a central portion of the laminated dielectric filter according to the fourth embodiment.

FIGS. 14 and 15 show a laminated dielectric filter according to a fourth embodiment of the present invention.

The laminated dielectric filter according to the fourth embodiment differs from the laminated dielectric filter according to the third embodiment in that an input electrode 28, an output electrode 30, an electrode 92, and an electrode 96 have different shapes from those of the corresponding electrodes of the laminated dielectric filter according to the third embodiment. The other structural details of the laminated dielectric filter according to the fourth embodiment are the same as those of the laminated dielectric filter according to the third embodiment. The laminated dielectric filter according to the fourth embodiment may be manufactured in the same manner as the laminated dielectric filter according to the third embodiment.

In the fourth embodiment, as shown in FIG. 14, the input electrode 28 has a wider portion 110 overlapping the resonant element 14, and the electrode 94 has a wider portion 112 overlapping the resonant element 14, with the wider portions 110, 112 overlapping each other. The electrode 94 has a wider portion 114 overlapping the resonant element 16, and the electrode 96 has a wider portion 116 overlapping the resonant element 16, with the wider portions 114, 116 overlapping each other. The electrode 96 has a wider portion 118 overlapping the resonant element 18, and the output electrode 30 has a wider portion 120 overlapping the resonant element 18, with the wider portions 118, 120 overlapping each other.

The wider portions 110, 112 increase the values of the capacitances 83, 84 on the opposite sides of the resonant element 14. The wider portions 114, 116 increase the values of the capacitances 100, 102 on the opposite sides of the resonant element 16. The wider portions 118, 120 increase the values of the capacitances 90, 88 on the opposite sides of the resonant element 18.

As shown in FIG. 15, when the laminated dielectric filter is viewed in plan, the wider portions 110, 112 are shaped so that they are smaller than the resonant element 14 and positioned fully within the surface area of the resonant element 14, the wider portions 116, 114 are shaped so that they are smaller than the resonant element 16 and positioned fully within the surface area of the resonant element 16, and the wider portions 118, 120 are shaped so that they are smaller than the resonant element 18 and positioned fully within the surface area of the resonant element 18. Consequently, the values of the capacitances 83, 84, 100, 102, 90, 88 are prevented from being varied even if the dielectric layers 82, 10, 26 are stacked slightly out of alignment with each other.

Furthermore, the input electrode 28 has a wider portion 120 where the input electrode 28 overlaps the electrode 94, the wider portion 120 being wider than the electrode 94. The electrode 96 has a wider portion 122 where the electrode 96 overlaps the electrode 94, the wider portion 122 being wider than the electrode 94. The electrode 94 has a wider portion 124 where the electrode 94 overlaps the electrode 96, the wider portion 124 being wider than the electrode 96. The output electrode 30 has a wider portion 126 where the output electrode 30 overlaps the electrode 96, the wider portion 126 being wider than the electrode 96. Therefore, the values of the capacitances 86, 108, 92 formed by these overlapping portions are prevented from being varied even if the dielectric layers 82, 10, 26 are stacked slightly out of alignment with each other.

5th Embodiment

Figure 16:
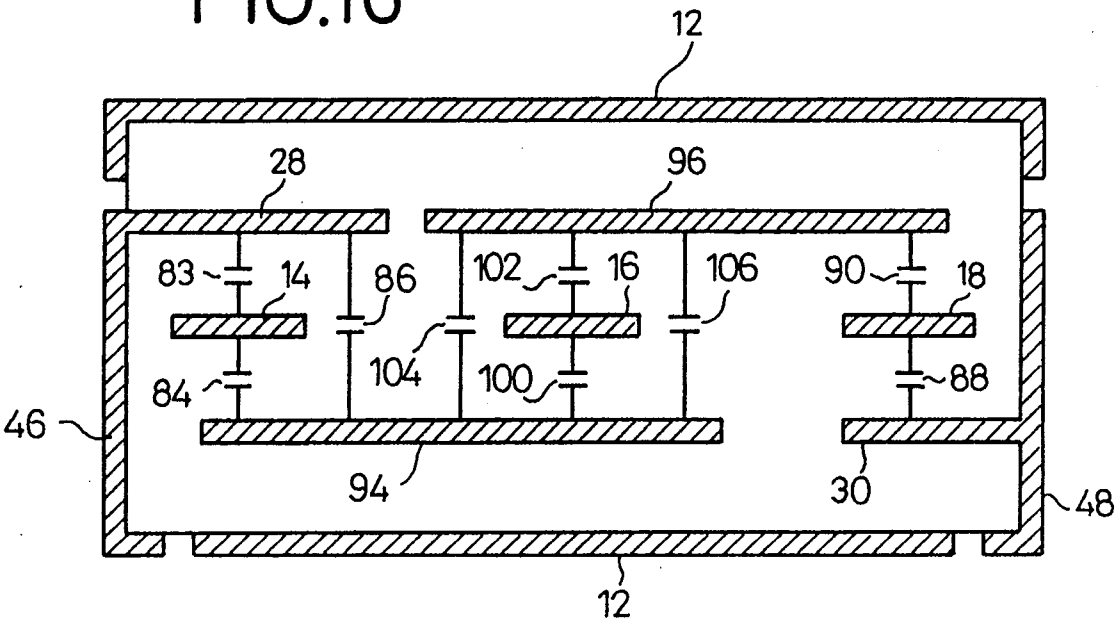
FIG. 16 is a cross-sectional view of a laminated dielectric filter according to a fifth embodiment of the present invention.
Figure 17:
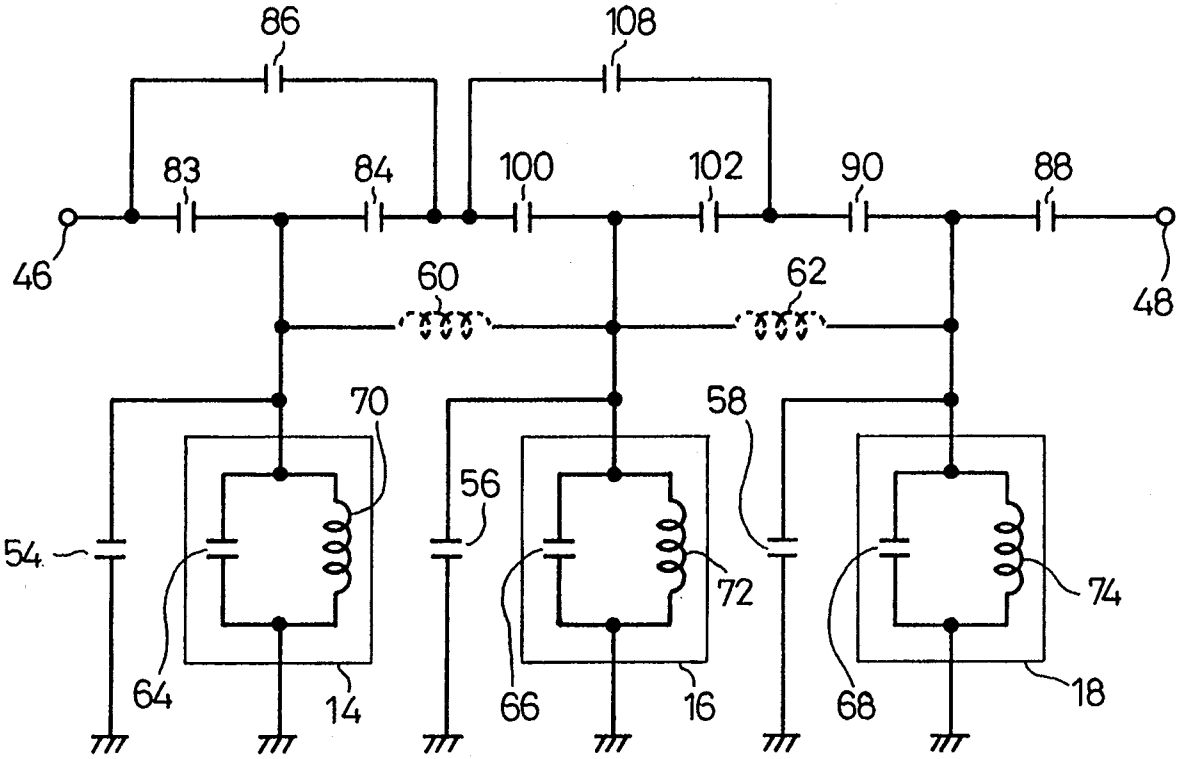
FIG. 17 is a circuit diagram of an equivalent circuit of the laminated dielectric filter according to the fifth embodiment.

FIGS. 16 and 17 show a laminated dielectric filter according to a fifth embodiment of the present invention.

The laminated dielectric filter according to the fifth embodiment differs from the laminated dielectric filter according to the fourth embodiment in that an output electrode 30 is positioned in confronting relationship to a resonant element 18 only, but not an electrode 96. The other structural details of the laminated dielectric filter according to the fifth embodiment are the same as those of the laminated dielectric filter according to the fourth embodiment. The laminated dielectric filter according to the fifth embodiment may be manufactured in the same manner as the laminated dielectric filter according to the fourth embodiment.

In the fifth embodiment, as shown in FIG. 16, the output electrode 30 is not positioned in confronting relationship to the electrode 96. Thus, no jumped coupling capacitance is formed to couple capacitances 90, 88 on the opposite sides of the resonant element 18. However, since a jumped coupling capacitance 86 is formed to couple capacitances 83, 84 on the opposite sides of a resonant element 14 and a jumped coupling capacitance 108 is formed to couple capacitances 100, 102 on the opposite sides of a resonant element 16, an attenuation pole is provided below the passband of the bandpass filter.

In the fifth embodiment, an input electrode 28 is positioned in confronting relationship to the electrode 94 and the output electrode 30 is not positioned in confronting relationship to the electrode 96. However, the input electrode 28 may not be positioned in confronting relationship to the electrode 94 and the output electrode 30 may be positioned in confronting relationship to the electrode 96. In such a modification, while no jumped coupling capacitance is formed to couple the capacitances 83, 84 on the opposite sides of the resonant element 14, a jumped coupling capacitance is formed to couple the capacitances 100, 102 on the opposite sides of the resonant element 16, and a jumped coupling capacitance is formed to couple the capacitances 90, 88 on the opposite sides of the resonant element 18, so that an attenuation pole is produced below the passband of the bandpass filter.

6th Embodiment

Figure 18:
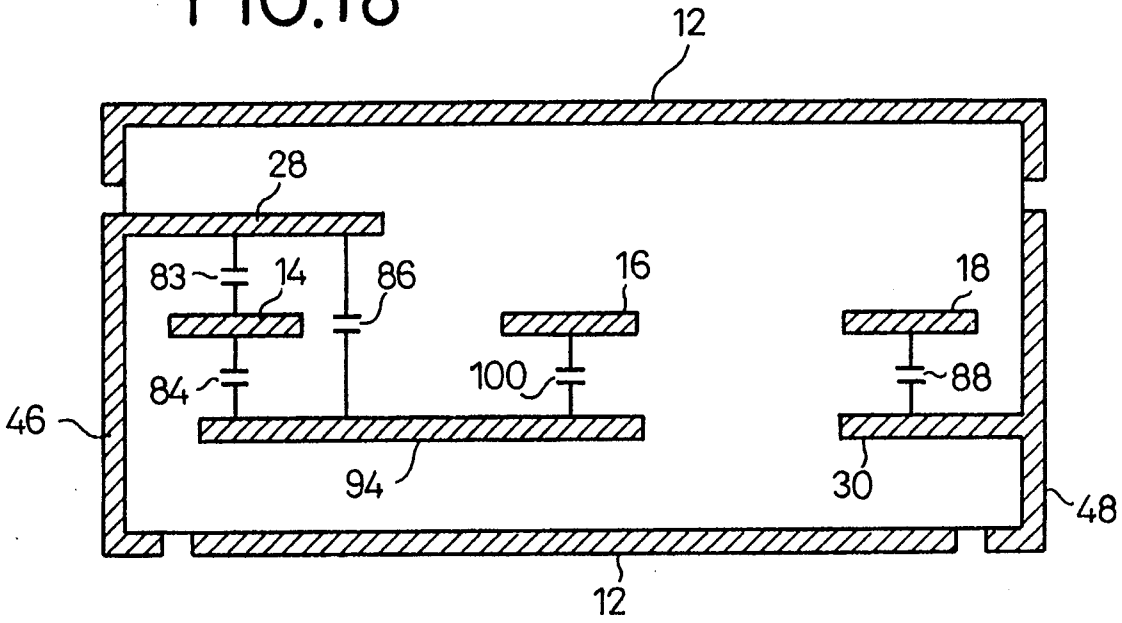
FIG. 18 is a cross-sectional view of a laminated dielectric filter according to a sixth embodiment of the present invention.
Figure 19:
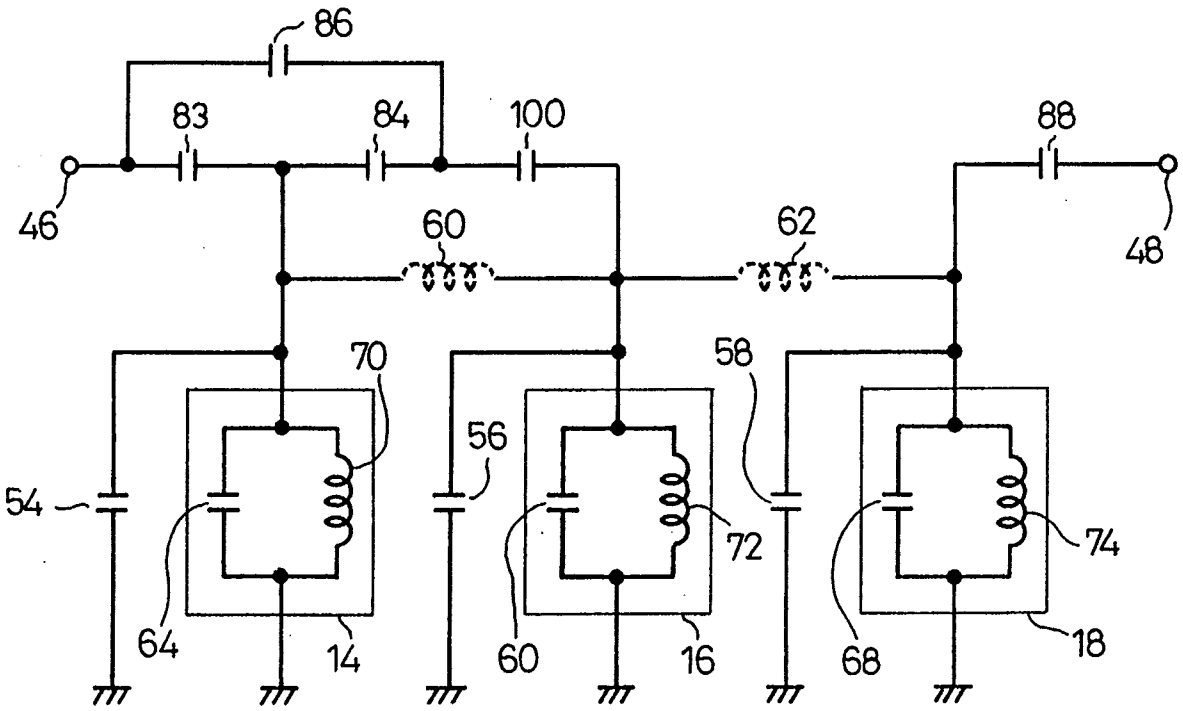
FIG. 19 is a circuit diagram of an equivalent circuit of the laminated dielectric filter according to the sixth embodiment.

FIGS. 18 and 19 show a laminated dielectric filter according to a sixth embodiment of the present invention.

The laminated dielectric filter according to the sixth embodiment differs from the laminated dielectric filter according to the fourth embodiment in that no electrode is positioned in confronting relationship to both resonant elements 16, 18, and an output electrode 30 is positioned in confronting relationship to the resonant element 18 only. The other structural details of the laminated dielectric filter according to the sixth embodiment are the same as those of the laminated dielectric filter according to the fourth embodiment. The laminated dielectric filter according to the sixth embodiment may be manufactured in the same manner as the laminated dielectric filter according to the fourth embodiment.

In the sixth embodiment, as shown in FIG. 18, no electrode is positioned in confronting relationship to both the resonant elements 16, 18, and an output electrode 30 is positioned in confronting relationship to the resonant element 18 only. Therefore, no jumped coupling capacitance is present which would otherwise couple a capacitance on the output side of the resonant element 16, a capacitance on the input side of the resonant element 18, and capacitances on the opposite sides of the resonant element 16, and no jumped coupling capacitance is present which would otherwise couple capacitances on the opposite sides of the resonant element 18. The resonant elements 16, 18 are coupled to each other by inductive coupling represented by an inductance 62. However, a jumped coupling capacitance 86 is present which couples the capacitances 83, 84 on the opposite sides of the resonant element 14. Since the jumped coupling capacitance 86 is present which couples the capacitances 83, 84, an attenuation pole is produced below the passband of the bandpass filter.

In the sixth embodiment, the electrode 94 confronts both the resonant electrodes 14, 16, and an input electrode 28 is positioned in confronting relationship to the electrode 94. However, an electrode may be provided which confronts both the resonant elements 16, 18, and the output electrode 30 may be positioned in confronting relationship to such an electrode. In such a modification, jumped coupling capacitances are formed on the opposite sides of the resonant element 18, and a jumped coupling capacitance is formed to couple the capacitances 90, 88, so that an attenuation pole is produced below the passband of the bandpass filter.

7th Embodiment

Figure 20:
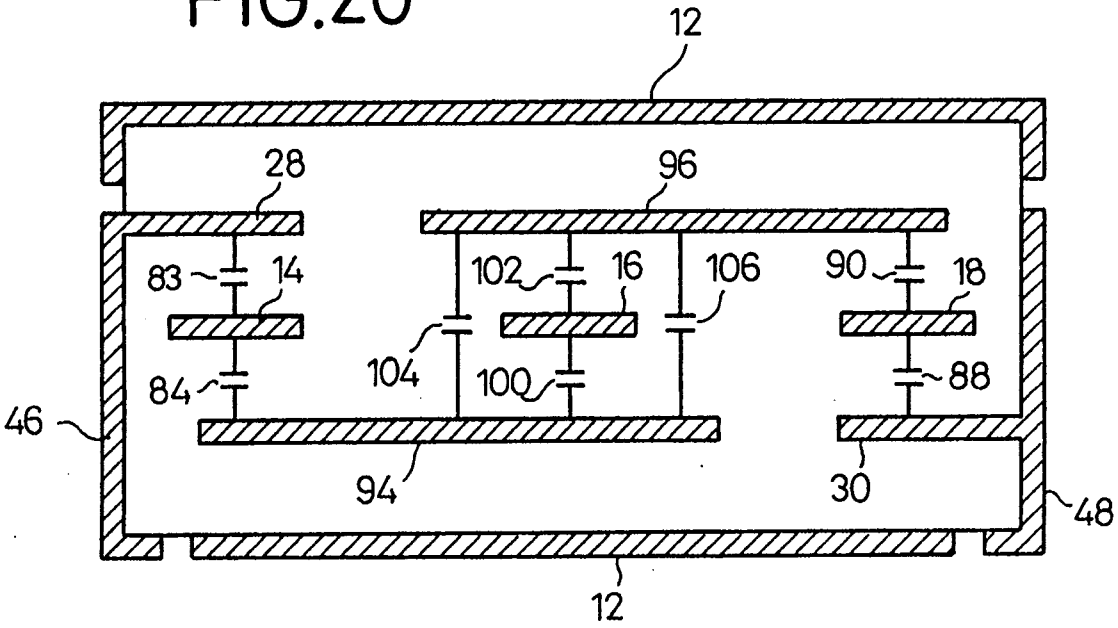
FIG. 20 is a cross-sectional view of a laminated dielectric filter according to a seventh embodiment of the present invention.
Figure 21:
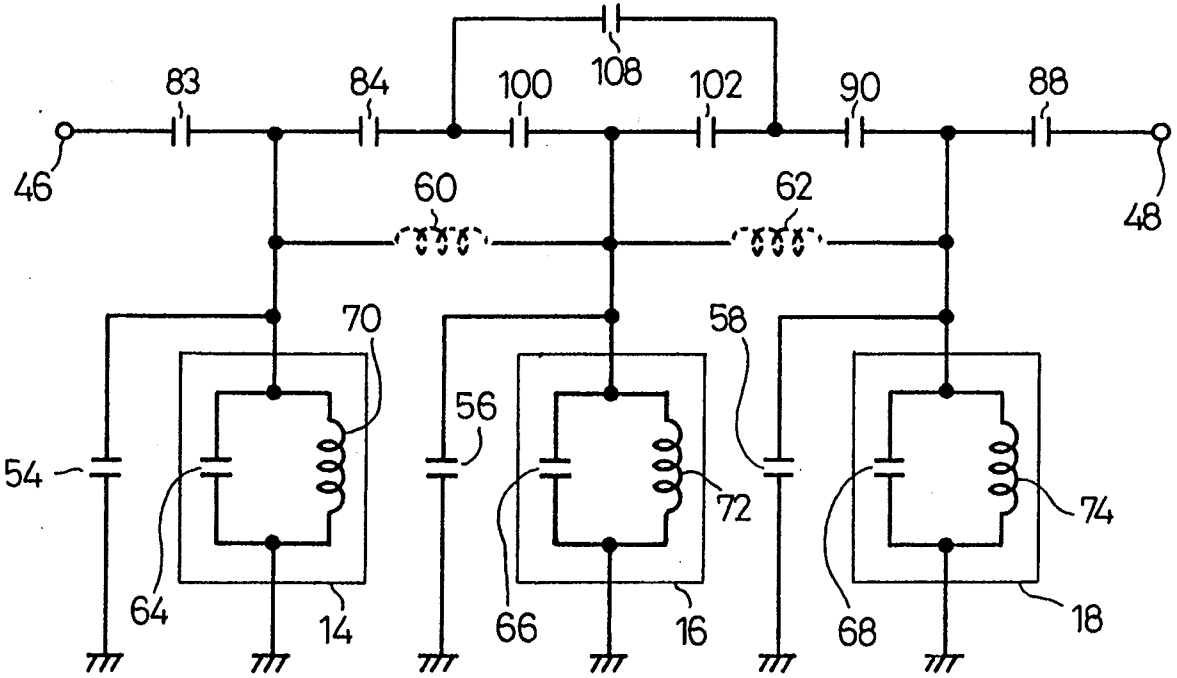
FIG. 21 is a circuit diagram of an equivalent circuit of the laminated dielectric filter according to the seventh embodiment.

FIGS. 20 and 21 show a laminated dielectric filter according to a seventh embodiment of the present invention.

The laminated dielectric filter according to the seventh embodiment differs from the laminated dielectric filter according to the fourth embodiment in that an input electrode 28 is not positioned in confronting relationship to an electrode 94, and an output electrode 30 is positioned in confronting relationship to a resonant element 18 only, but not an electrode 96. The other structural details of the laminated dielectric filter according to the seventh embodiment are the same as those of the laminated dielectric filter according to the fourth embodiment. The laminated dielectric filter according to the seventh embodiment may be manufactured in the same manner as the laminated dielectric filter according to the fourth embodiment.

In the seventh embodiment, since the input electrode 28 does not confront the electrode 94, no jumped coupling capacitance is formed which would otherwise couple capacitances 83, 84 on the resonant element 14, and since the output electrode 30 does not confront the electrode 96, no jumped coupling capacitance is formed which would otherwise couple capacitances 90, 88 on the resonant element 18. However, a jumped coupling capacitance 108 is present which couples the capacitances 100, 102 on the opposite sides of the resonant element 16, so that an attenuation pole is produced below the passband of the bandpass filter.

Although certain preferred embodiments of the present invention has been shown and described in detail, it should be understood that various changes and modifications may be made therein without departing from the scope of the appended claims.

What is claimed is:

1. A laminated dielectric filter comprising:
- a dielectric body;
- at least one around electrode provided on an outer surface of said dielectric body;
- a first resonant element disposed in said dielectric body and having a first main surface and a second main surface opposite each other;
- a second resonant element disposed in said dielectric body and having a first main surface and a second main surface opposite each other;
- a first electrode disposed in said dielectric body in confronting relationship to a portion of said first main surface of said first resonant element and a portion of said first main surface of said second resonant element; and
- a second electrode disposed in said dielectric body in confronting relationship to a portion of said second main surface of said first resonant element and a portion of said first electrode, such that a capacitance is formed between said second electrode and said first electrode.

2. A laminated dielectric filter according to claim 1, further comprising a third electrode disposed in said dielectric body in confronting relationship to a portion of said second main surface of said second resonant element and a portion of said first electrode.

3. A laminated dielectric filter according to claim 2, further comprising a third resonant element disposed in said dielectric body on a side of said second resonant element opposite to said first resonant element, said third resonant element having a first main surface and a second main surface opposite each other, said third electrode confronting a portion of said second main surface of said third resonant element.

4. A laminated dielectric filter according to claim 3, further comprising a fourth electrode disposed in said dielectric body in confronting relationship to a portion of said first main surface of said third resonant element and a portion of said third electrode.

5. A laminated dielectric filter according to claim 1, wherein said second electrode is used as an input electrode or an output electrode.

6. A laminated dielectric filter according to claim 2, wherein said second electrode is used as an input electrode or an output electrode, and said third electrode is used as the other of the input and output electrodes.

7. A laminated dielectric filter according to claim 4, wherein said second electrode is used as an input electrode or an output electrode, and said fourth electrode is used as the other of the input and output electrodes.

8. A laminated dielectric filter according to claim 1, wherein said at least one ground electrode includes a pair of mutually electrically interconnected ground electrodes provided on respective sides of said dielectric body.

9. A laminated dielectric filter according to claim 1, wherein said second electrode extends from a side of the dielectric body and beyond the first resonant element, the portion of the second electrode which extends beyond the first resonant element being in confronting relationship to said first electrode, such that the capacitance is formed therebetween.

* * * * *